US006147656A

United States Patent [19]

Luh

[11] Patent Number: 6,147,656

[45] Date of Patent: Nov. 14, 2000

[54] ACTIVE MULTIPLE BEAM ANTENNAS

[75] Inventor: Howard Ho-shou Luh, Sunnyvale, Calif.

[73] Assignee: Space Systems/Loral, Inc., Palo Alto, Calif.

[21] Appl. No.: 09/283,059

[22] Filed: Apr. 1, 1999

[51] Int. Cl.[7] ..... H01Q 19/06

[52] U.S. Cl. ..... 343/753; 343/909

[58] Field of Search ..... 343/753, 909, 343/911 R, 911 L; 342/362, 373; H01Q 19/06

[56] References Cited

U.S. PATENT DOCUMENTS

| | | | |
|---|---|---|---|
| 3,979,750 | 9/1976 | Smith | 343/754 |
| 4,229,740 | 10/1980 | Krilanovich | 343/853 |
| 5,515,009 | 5/1996 | Wong et al. | 343/786 |
| 5,736,963 | 4/1998 | Roederer | 342/373 |
| 6,020,848 | 2/2000 | Wallace et al. | 342/362 |

*Primary Examiner*—Don Wong
*Assistant Examiner*—Hoang Nguyen
*Attorney, Agent, or Firm*—Kenneth W. Float

[57] ABSTRACT

Improved active multiple beam antennas that comprise an amplifier array or grid amplifier having substantially identical amplifiers. A feed array having a plurality of antenna elements provides RF energy. A microwave lens is disposed adjacent to the feed array that weakly focuses the RF energy from the feed array. The amplifier array or grid amplifier is disposed opposite the microwave lens from the feed array. The feed array illuminates the amplifier array or grid amplifier via the microwave lens. The weakly focused RF signals are amplified without changing their respective directions of propagation, which forms powerful multiple beams in the far field.

8 Claims, 1 Drawing Sheet

ACTIVE MULTIPLE BEAM ANTENNAS

BACKGROUND

The present invention relates generally to multiple beam antennas, and more particularly, to improved active multiple beam antennas.

A known active multiple beam antenna includes an active lens and a feed array. The active lens is assembled using multiple amplifier units. Each amplifier unit includes a monolithic microwave integrated circuit (MMIC) amplifier, an unequal length RF transmission line and two RF radiators. The active lens provides two functions including amplification and collimation of the RF signal.

However, not all amplifier units are identical. Consequently, different sets of amplifier units must be designed and fabricated. For a typical active multiple beam antenna that includes 3000 amplifier units, this means that on the order of 600 different amplifier units must be designed. Furthermore, each amplifier unit (3000) must then be located at its proper location. This is a labor intensive task.

Therefore, it is an objective of the present invention to provide for improved active multiple beam antennas that overcomes the limitations of conventional active multiple beam antennas.

SUMMARY OF THE INVENTION

The present invention provides for active multiple beam antennas that comprise an amplifier array or grid amplifier that comprises a plurality of substantially identical amplifiers. The active multiple beam antennas comprises a feed array having a plurality of antenna elements. A microwave lens is disposed adjacent to the feed array that weakly focuses the RF energy from the feed array. The amplifier array or grid amplifier is disposed opposite the microwave lens from the feed array. The feed array illuminates the amplifier array or grid amplifier via the microwave lens. The weakly focused RF signals are amplified without changing their respective directions of propagation, which forms powerful multiple beams in the far field.

BRIEF DESCRIPTION OF THE DRAWINGS

The various features and advantages of the present invention may be more readily understood with reference to the following detailed description taken in conjunction with the accompanying drawing figures, wherein like reference numerals designate like structural elements, and in which.

DETAILED DESCRIPTION

Figure 1:
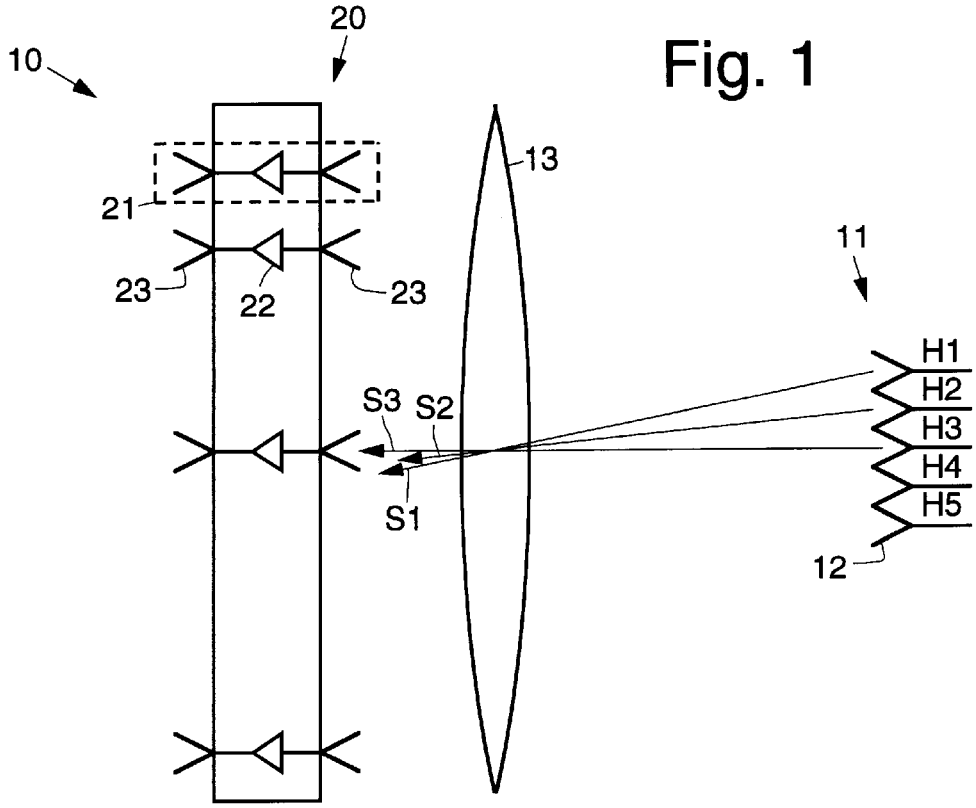
FIG. 1 illustrates a first embodiment of an exemplary active multiple beam antenna in accordance with the principles of the present invention.

Referring to the drawing figures, FIG. 1 illustrates a first embodiment of an exemplary active multiple beam antenna 10 in accordance with the principles of the present invention. The first exemplary active multiple beam antenna 10 comprises a feed array 11 comprising a plurality of antenna elements 12. The feed array 11 is disposed on one side of a microwave lens 13 and illuminates the microwave lens 13 with RF/microwave energy transmitted by each of the antenna elements 12. An amplifier array 20 is disposed on the opposite side of the microwave lens 13 from the feed array 11. The amplifier array 20 comprises a plurality of amplifier units 21. Each amplifier unit 21 includes a MMIC amplifier 22 coupled between input and output RF radiators 22, 23.

The feed array 11 and the microwave lens 13 provides weakly collimated RF signals in different directions (S1, S2, S3) that emanate from each of the respective antenna elements 12 of the feed array 11. For example, an RF signal from an antenna element 11 identified as H2 will be radiated in the direction of S2, and so forth. All amplifiers 22 in the amplifier array 20 are identical and are disposed in front of the lens 13. Consequently, the weakly focused RF signals are amplified by the amplifier 22 without changing their respective directions of propagation. This forms powerful multiple beams in the far field.

Figure 2:
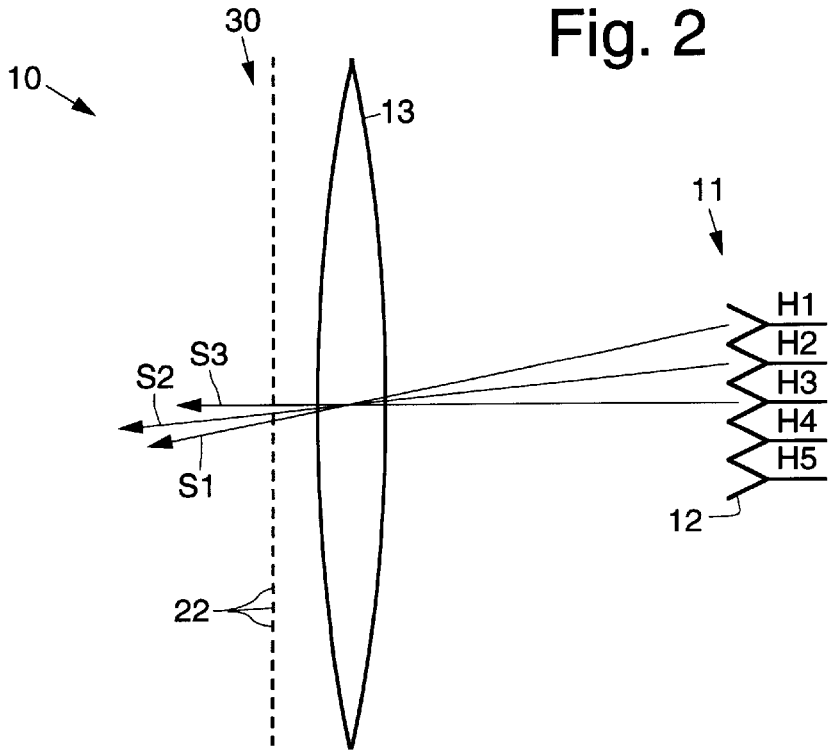
FIG. 2 illustrates a second embodiment of an active exemplary multiple beam antenna in accordance with the principles of the present invention.

FIG. 2 illustrates a second embodiment of an exemplary active multiple beam antenna 10 in accordance with the principles of the present invention. The second exemplary active multiple beam antenna 10 comprises a feed array 11 comprising a plurality of antenna elements 12. The feed array 11 is disposed on one side of a microwave lens 13 and illuminates the microwave lens 13 with RF/microwave energy transmitted by each of the antenna elements 12.

In the second embodiment, the amplifier array 20 is replaced by a grid amplifier 30 comprising a plurality of substantially identical amplifiers 22. The grid amplifier 30 is disposed on the opposite side of the microwave lens 13 from the feed array 11. The grid amplifier 30 may be similar to an amplifier such disclosed by M. Kim et al. in a paper entitled "A 100-Element HBT Grid Amplifier," published in IEEE Trans. Microwave Theory Tech., vol. 41, pp. 1762–1771, October 1983, for example.

Again, the feed array 11 and the microwave lens 13 provides weakly collimated RF signals in different directions. All of the amplifiers in the grid amplifier 30 are disposed in front of the lens 13. Thus, the weakly focused RF signals are amplified by the grid amplifier 30 without changing their respective directions of propagation, which forms powerful multiple beams in the far field.

One advantage provided by the present invention is its simplified construction. In the present antennas 10, RF energy collimation is provided by the RF/microwave lens 12. Furthermore, all amplifier units (3000) are identical. The design and fabrication tasks for the various embodiments of the active multiple beam antenna 10 are simplified compared with the design and fabrication tasks required for a conventional antenna. Furthermore, the conventional amplifier units may be replaced by the grid amplifier 30, for example. This further simplifies the construction of the active multiple beam antenna 10 because the grid amplifier 30 can be mass produced by a printing technique, since all amplifier units are identical.

Thus, improved active multiple beam antennas have been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. An active multiple beam antenna comprising:

a feed array comprising a plurality of antenna elements;

a microwave lens disposed adjacent to the feed array that is illuminated by RF signals from the feed array and that weakly focuses the RF signals;

an amplifier array is disposed opposite the microwave lens from the feed array that comprises a plurality of amplifiers that amplify the weakly focused RF signals without changing their respective directions of propagation to form multiple beams in the far field.

2. The system recited in claim 1 wherein the amplifier array comprises a plurality of amplifier units.

3. The system recited in claim 2 wherein each amplifier unit comprises a MMIC amplifier coupled between input and output RF radiators.

4. The system recited in claim 1 wherein the microwave lens provides weakly collimated RF signals in different directions corresponding to each of the respective antenna elements of the feed array, and the weakly focused RF signals are amplified without changing their respective directions of propagation to form powerful multiple beams in the far field.

5. The system recited in claim 1 wherein the amplifier array comprises a grid amplifier.

6. The system recited in claim 5 wherein the grid amplifier comprises a plurality of amplifiers.

7. An active multiple beam antenna comprising:

a feed array comprising a plurality of antenna elements;

a microwave lens disposed adjacent to the feed array that is illuminated by RF signals from the feed array and that weakly focuses the RF signals;

a grid amplifier is disposed opposite the microwave lens from the feed array that comprises a plurality of amplifiers that amplify the weakly focused RF signals without changing their respective directions of propagation to form multiple beams in the far field.

8. The system recited in claim 7 wherein the microwave lens provides weakly collimated RF signals in different directions corresponding to each of the respective antenna elements of the feed array, and the weakly focused RF signals are amplified without changing their respective directions of propagation to form powerful multiple beams in the far field.

* * * * *